US011536434B2

(12) United States Patent
Herbin et al.

(10) Patent No.: US 11,536,434 B2
(45) Date of Patent: Dec. 27, 2022

(54) LUMINOUS DEVICE

(71) Applicant: VALEO VISION, Bobigny (FR)

(72) Inventors: Cyril Herbin, Bobigny (FR); Lucas Perdrix, Meslin l'Eveque (BE); Paulo Ferreira, Meslin l'Eveque (BE)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/298,411

(22) PCT Filed: Nov. 15, 2019

(86) PCT No.: PCT/EP2019/081538

§ 371 (c)(1),
(2) Date: May 28, 2021

(87) PCT Pub. No.: WO2020/109037

PCT Pub. Date: Jun. 4, 2020

(65) Prior Publication Data

US 2022/0120405 A1 Apr. 21, 2022

(30) Foreign Application Priority Data

Nov. 30, 2018 (FR) ..... 18 72178
Aug. 30, 2019 (FR) ..... 19 09584

(51) Int. Cl.
*F21S 43/27* (2018.01)
*F21S 43/237* (2018.01)
(Continued)

(52) U.S. Cl.
CPC ..... *F21S 43/27* (2018.01); *F21S 43/14* (2018.01); *F21S 43/19* (2018.01); *F21S 43/237* (2018.01)

(58) Field of Classification Search
CPC ..... F21S 43/27; F21S 43/237; F21S 43/14; F21S 43/19
See application file for complete search history.

(56) References Cited

U.S. PATENT DOCUMENTS 9,068,709 B2 * 6/2015 Baert ..... F21S 43/245
9,458,979 B2 * 10/2016 Song ..... B60Q 1/2607
(Continued)

FOREIGN PATENT DOCUMENTS

CN 106958787 A 7/2017
CN 107191858 A 9/2017
(Continued)

OTHER PUBLICATIONS

International Search Report dated Feb. 14, 2020 in PCT/EP2019/081538 filed Nov. 15, 2019, 3 pages.
(Continued)

*Primary Examiner* — Matthew J. Peerce
(74) *Attorney, Agent, or Firm* — Oblon, McClelland, Maier & Neustadt, L.L.P.

(57) ABSTRACT

The invention relates to a luminous motor-vehicle module including at least one light source, an open casing, and a closing element for closing said open casing. The open casing includes a housing for positioning on an optical element, the positioning housing includes a plurality of grooves, and a tab for hooking on a casing of said motor vehicle comprising the optical element and an outer lens for closing the casing, the luminous module being configured to make a rotation and hook, at the end of the rotation, onto the casing via said hooking tab of the open casing.

15 Claims, 15 Drawing Sheets

Figure 1A:
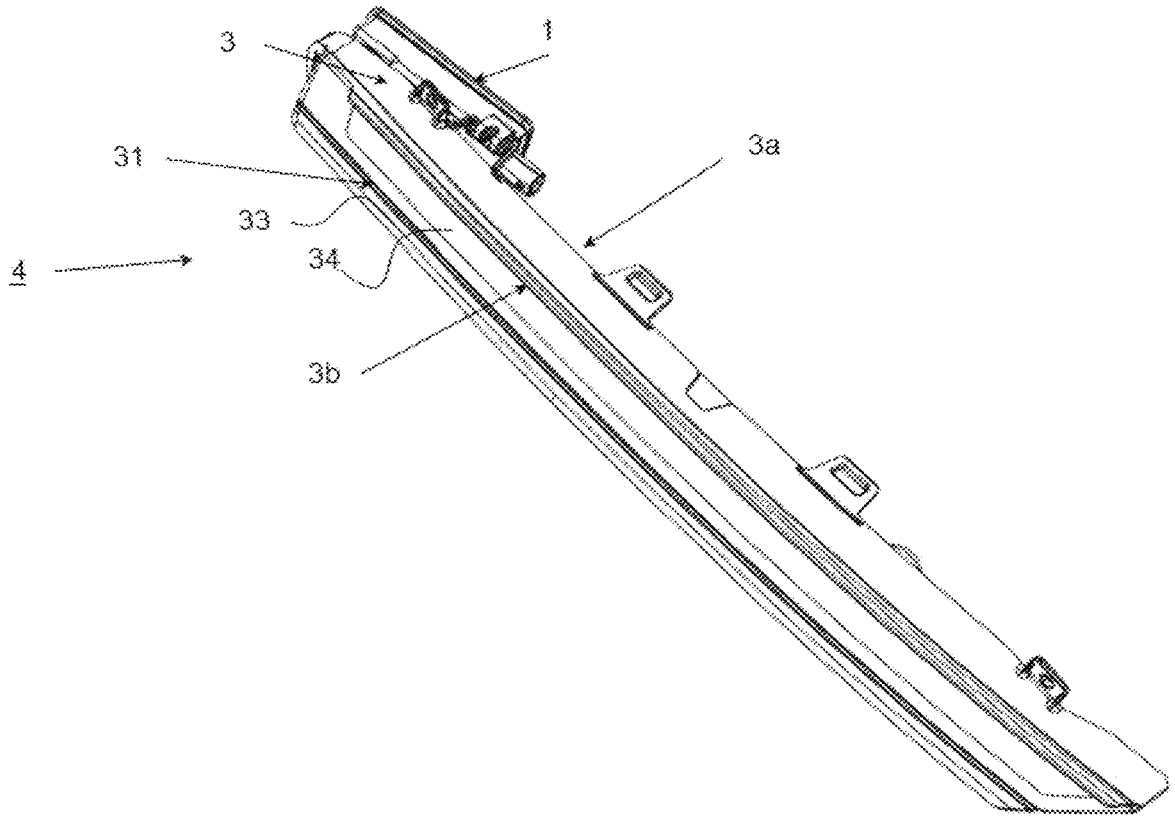

(51) Int. Cl.
*F21S 43/14* (2018.01)
*F21S 43/19* (2018.01)

(56) References Cited

U.S. PATENT DOCUMENTS

| | | | | |
|---|---|---|---|---|
| 10,443,803 | B2 * | 10/2019 | Edletzberger ..... | F21S 41/24 |
| 2004/0052089 | A1 | 3/2004 | Coto et al. | |
| 2017/0080847 | A1 | 3/2017 | Zhang | |
| 2017/0122532 | A1 | 5/2017 | Zhang | |
| 2017/0261168 | A1 | 9/2017 | Edletzberger et al. | |

FOREIGN PATENT DOCUMENTS

| | | | |
|---|---|---|---|
| DE | 11 2015 002 499 | T5 | 2/2017 |
| FR | 3 063 048 | A1 | 8/2018 |
| JP | 2016-9606 | A | 1/2016 |
| JP | 2017-41369 | A | 2/2017 |
| JP | 2017-134895 | A | 8/2017 |
| WO | WO 2016/040971 | A1 | 3/2016 |
| WO | WO 2017/168061 | A1 | 10/2017 |

OTHER PUBLICATIONS

Chinese Office Action dated Sep. 21, 2022 in Chinese Patent Application No. 201980077916.8 filed Nov. 15, 2019, 14 pages (with English Translation).

* cited by examiner

LUMINOUS DEVICE

The present invention relates to a luminous motor-vehicle module. Its particular but non-limiting application is to additional signaling lights.

A luminous module, such as an additional signaling light, known to those skilled in the art, comprises at least one light source, a light-source holder, an open casing, an element for closing the casing, and a cable harness for electrically connecting said at least one light source to an external connector of the motor vehicle. The luminous module is fastened, by means of a screw, to a motor-vehicle casing that is closed by an outer lens, and placed level with the grille of the front face of the motor vehicle. It is in particular fastened to an outer-lens holder level with said grille.

A drawback of this prior art is that, due to environmental constraints on the motor vehicle, there is little space in which to mount the luminous module on the motor vehicle. It is difficult to mount/demount the luminous module with a screwdriver due to the presence of other parts, such as the radiator, that are located behind the luminous module. Access with a view to mounting/demounting the module with a screwdriver is therefore difficult.

In this context, the present invention aims to provide a luminous module that allows the mentioned drawback to be resolved.

To this end, the invention provides a luminous motor-vehicle module comprising:

at least one light source, an open casing, a closing element for closing said open casing, characterized in that said open casing comprises a housing for positioning on an optical element, said positioning housing comprising a plurality of grooves, and a tab for hooking on a casing of said motor vehicle comprising said optical element and an outer lens for closing said casing, said luminous module being configured to make a rotation and hook, at the end of the rotation, onto said casing via said hooking tab of said open casing.

Thus, as will be seen in detail below, by virtue of the positioning housing, the grooves, and the hooking tab, it is no longer necessary to use a screwdriver to fasten the luminous module in place. Moreover, the rotation allows the luminous module to be easily mounted on the casing of the motor vehicle and facilitates operator access to the luminous module. Moreover, no longer using a screwdriver avoids damaging the outer-lens holder, since a screwing/unscrewing action need no longer be applied to the outer-lens holder.

According to non-limiting embodiments, the luminous motor-vehicle module may further comprise one or more additional features, which may be implemented alone or in any technically possible combination, from among the following.

According to one non-limiting embodiment, said optical element is a light guide.

According to one non-limiting embodiment, said positioning housing comprises two or three grooves.

According to one non-limiting embodiment, said hooking tab is configured to hook onto a hooking bracket of an optical-element holder of said casing of the motor vehicle, or onto a hooking bracket of an outer-lens holder of said casing of the motor vehicle.

A motor-vehicle casing is also provided, said casing comprising an optical element, characterized in that said casing further comprises:

an optical-element holder, an outer lens formed from an outer-lens holder and from a transparent optical part, a hooking bracket for a hooking tab of a luminous module, said hooking bracket being secured to said optical-element holder or to said outer-lens holder.

According to one non-limiting embodiment, said optical element comprises lugs for positioning a luminous module.

According to one non-limiting embodiment, said optical element is positioned at the center of said positioning lugs.

According to one non-limiting embodiment, the positioning lugs are arranged around said optical element.

A luminous device comprising a luminous module according to any one of the preceding features and a casing according to any one of the preceding features is also provided.

Figure 1B:
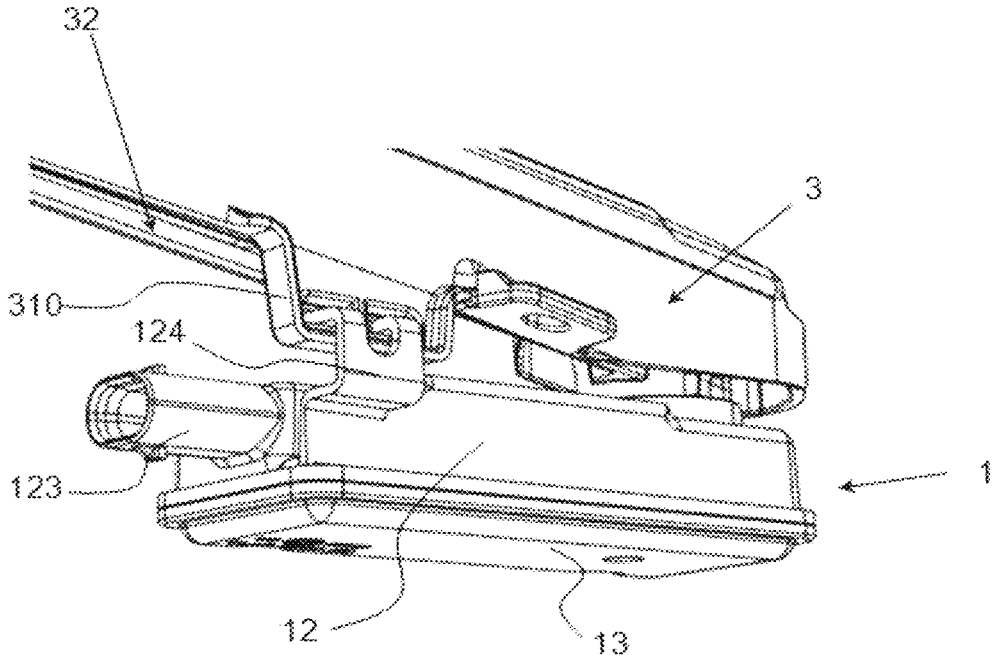
Figure 2:
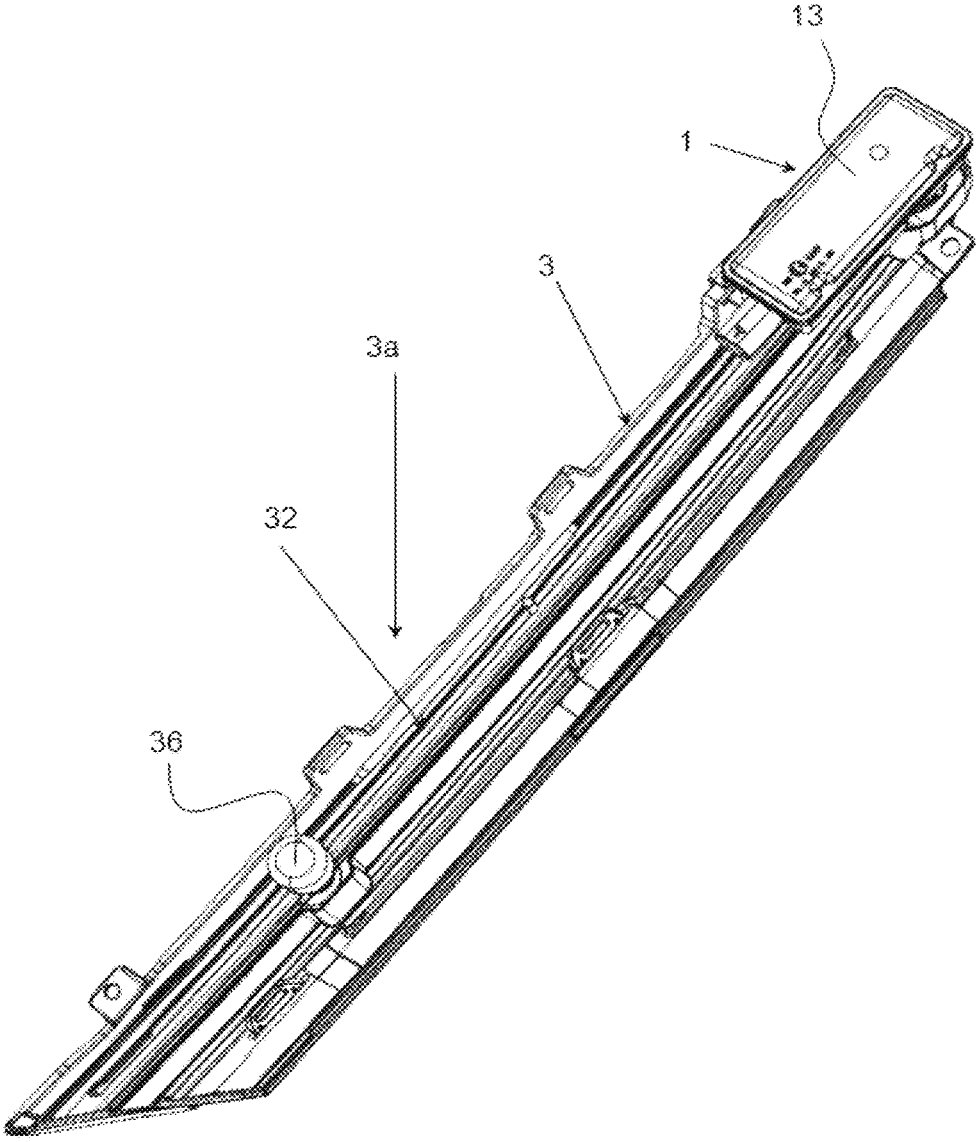
Figure 3A:
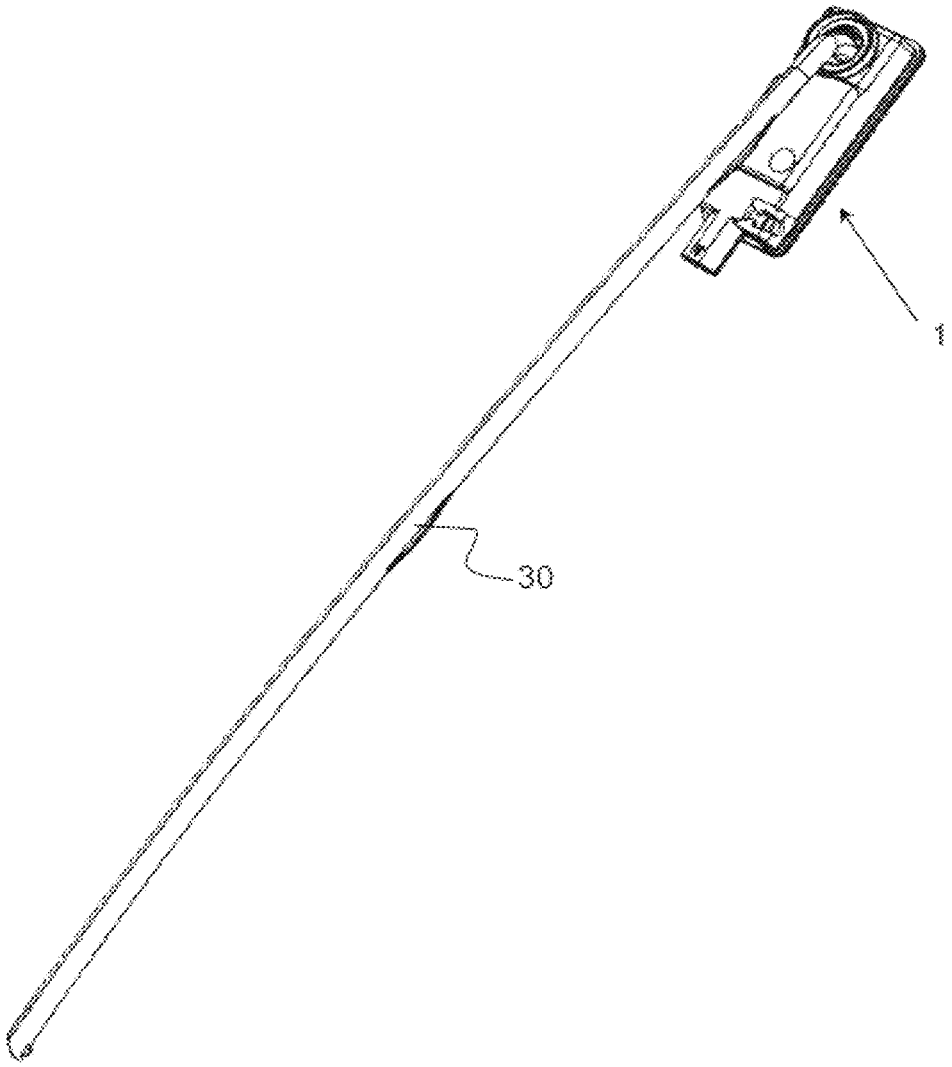
Figure 3B:
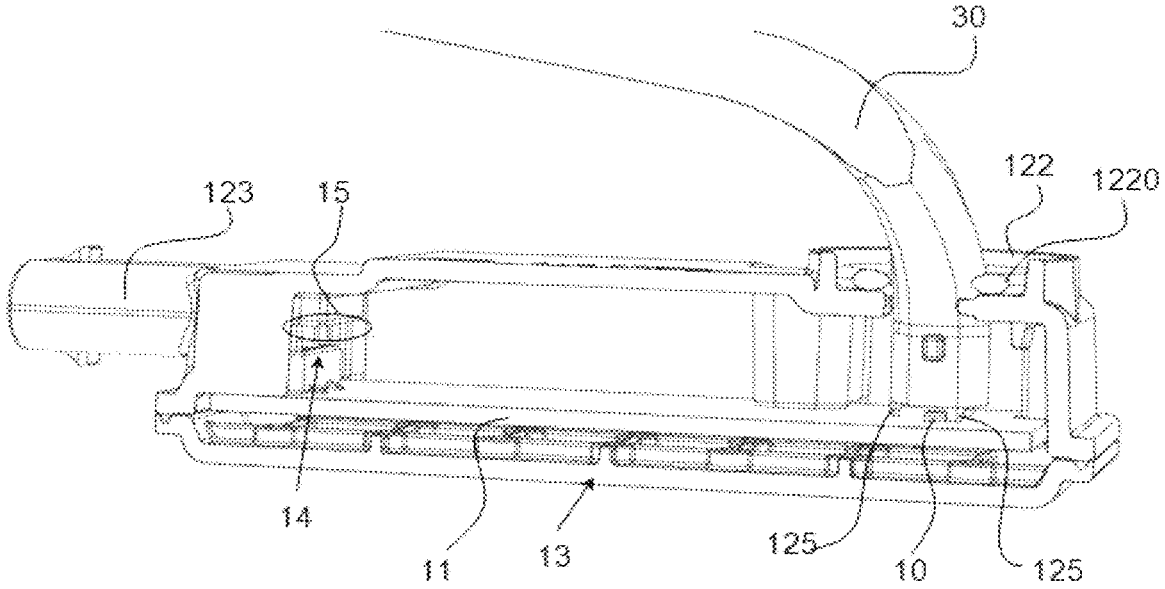
Figure 4A:
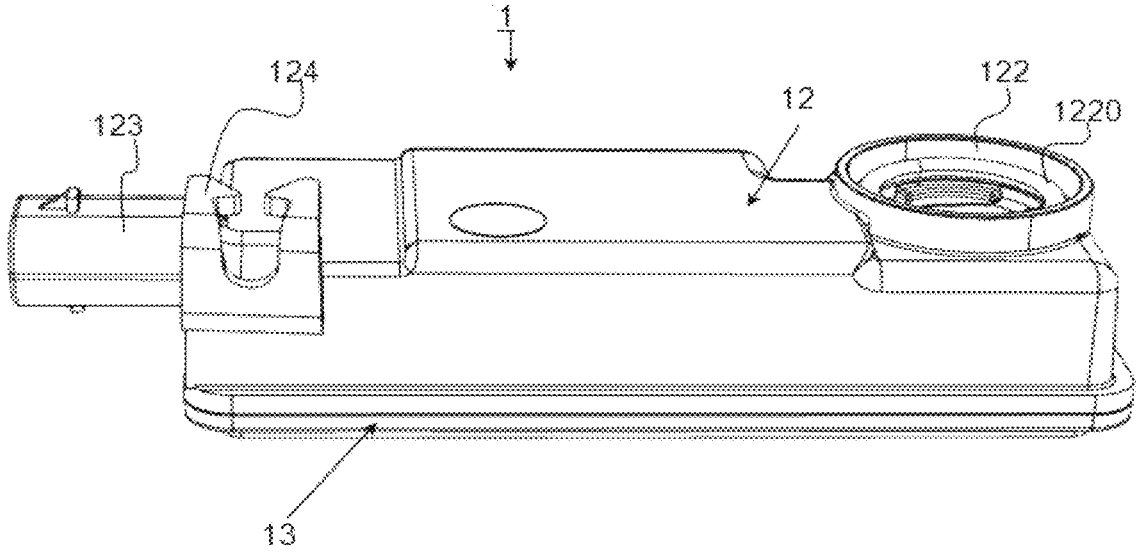
Figure 4B:
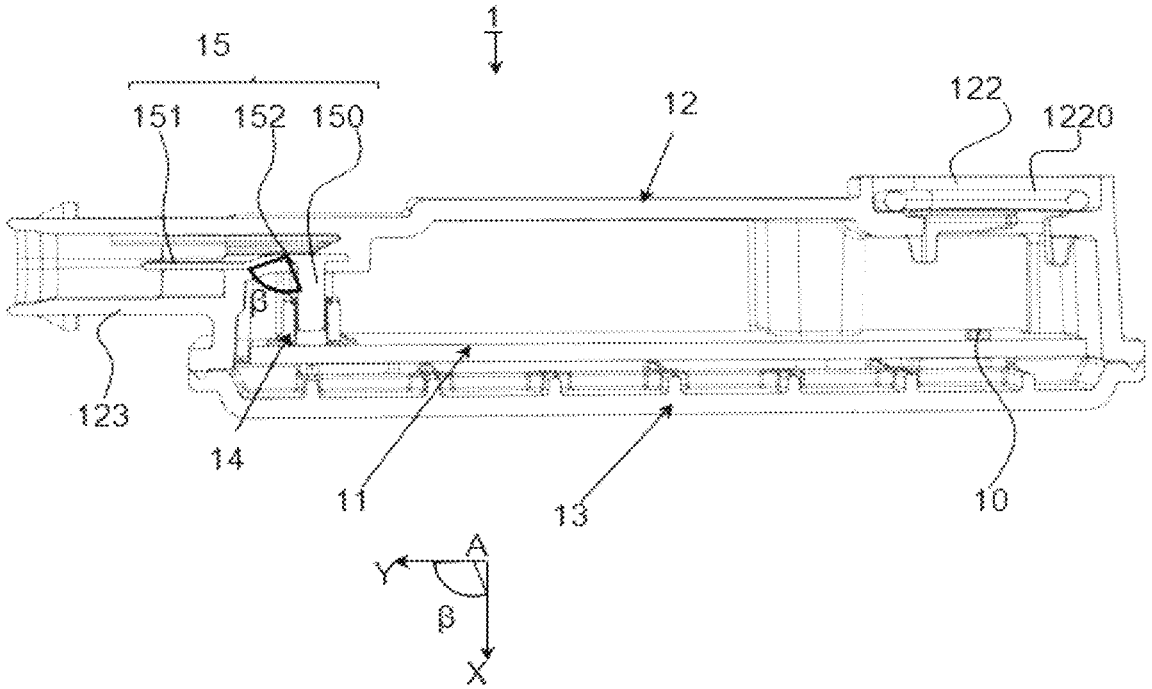
Figure 5:
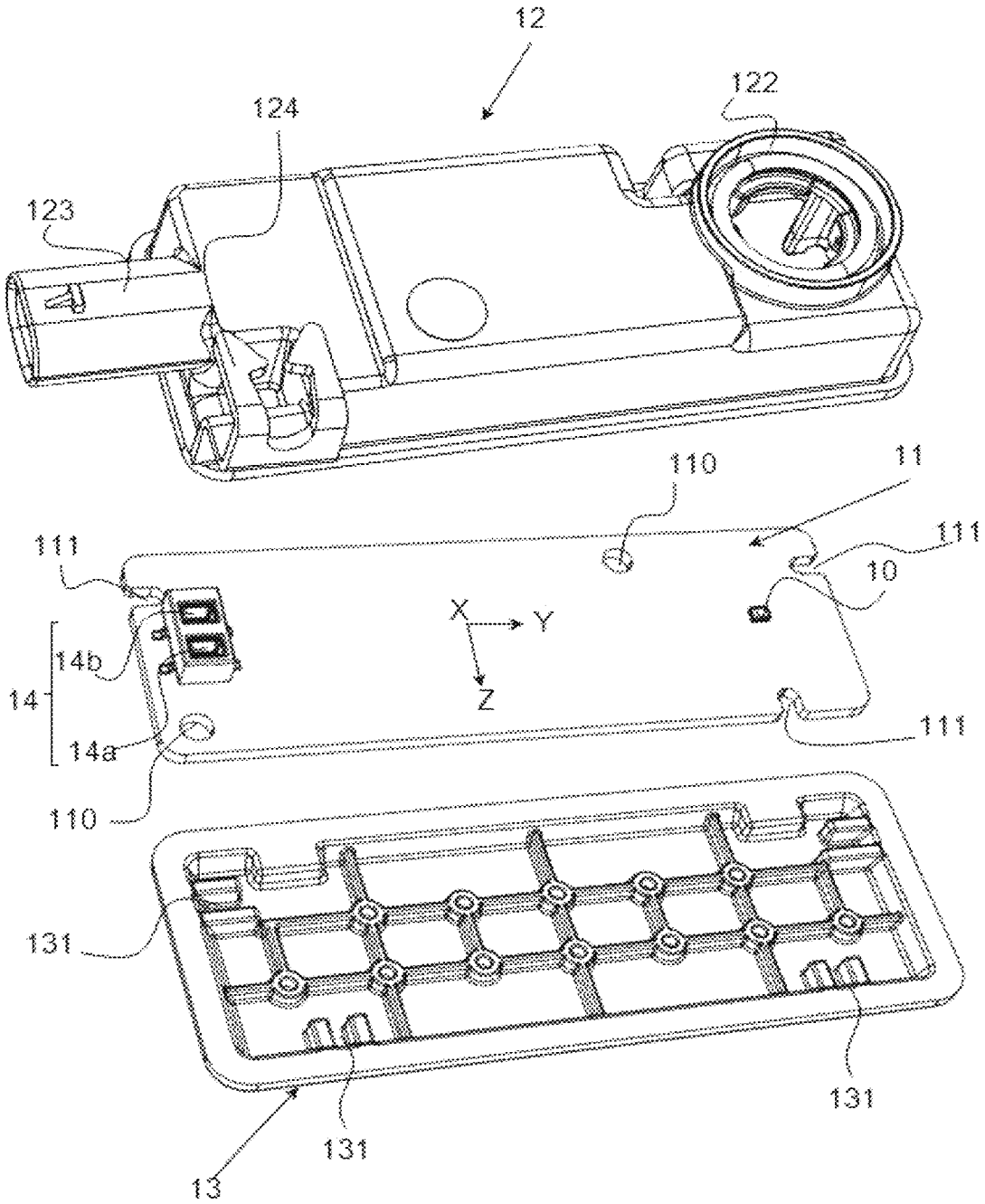
Figure 6A:
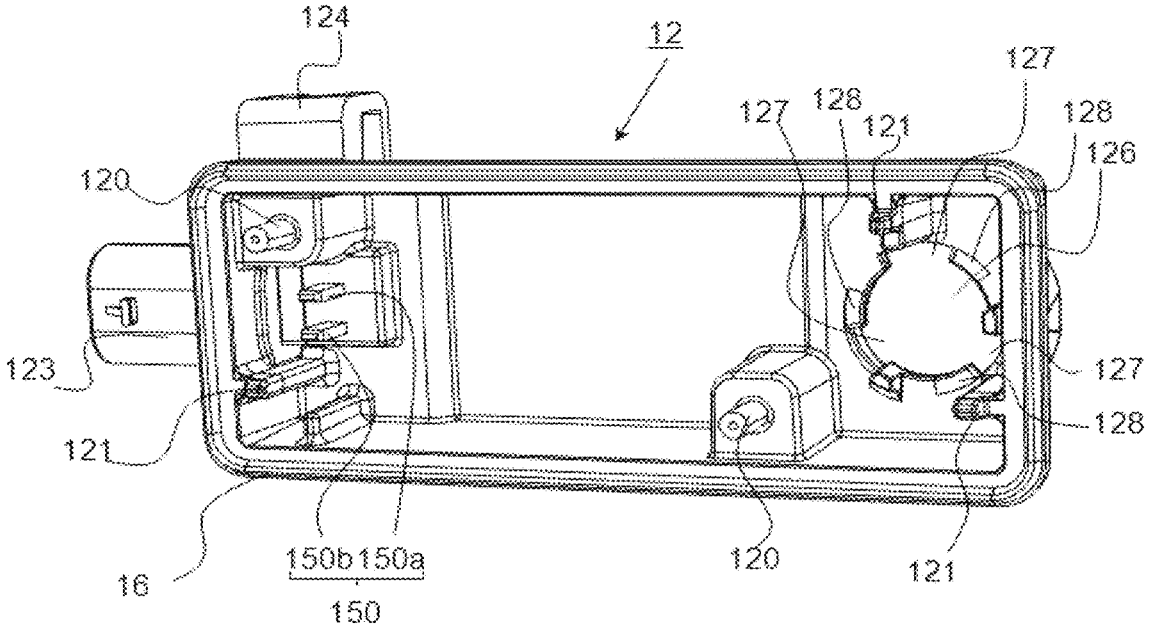
Figure 6B:
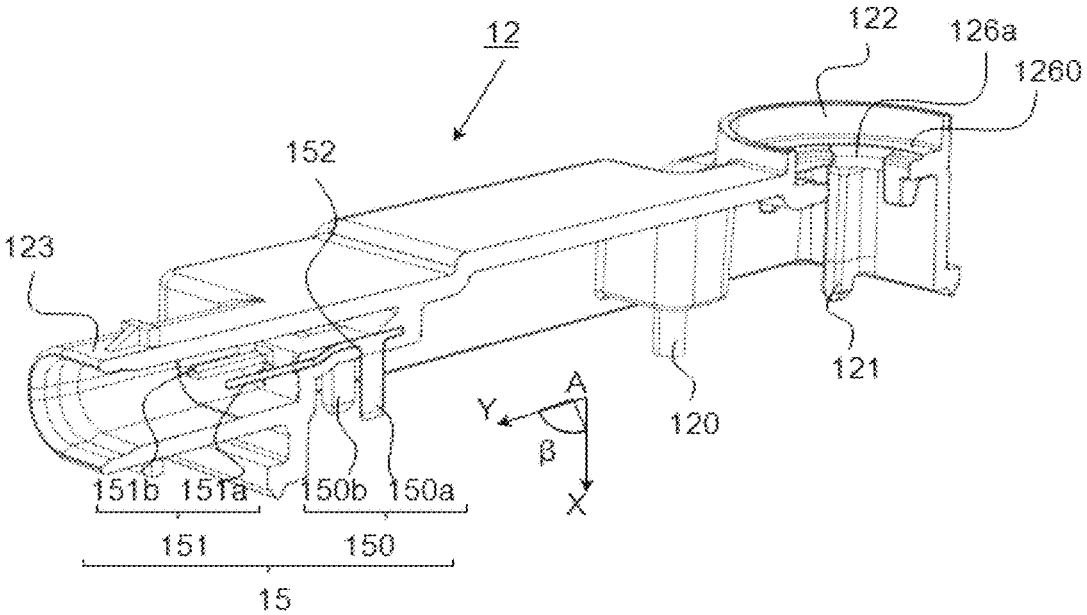
Figure 6C:
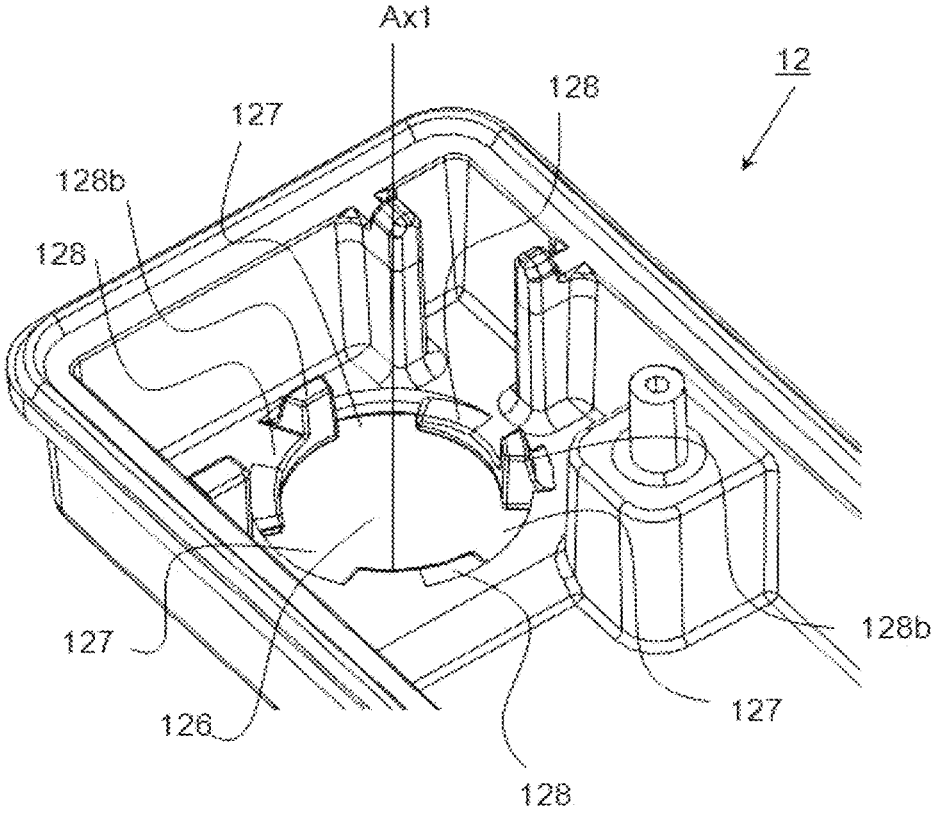
Figure 7A:
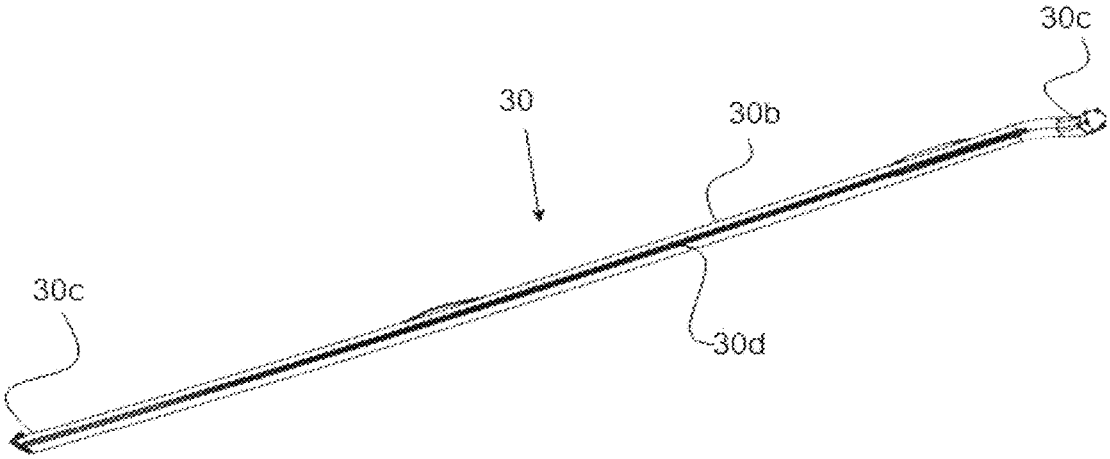
Figure 7B:
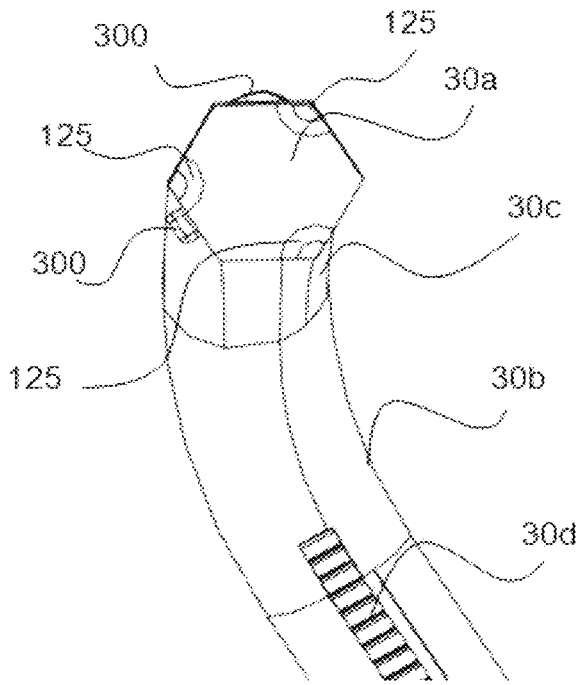
Figure 8:
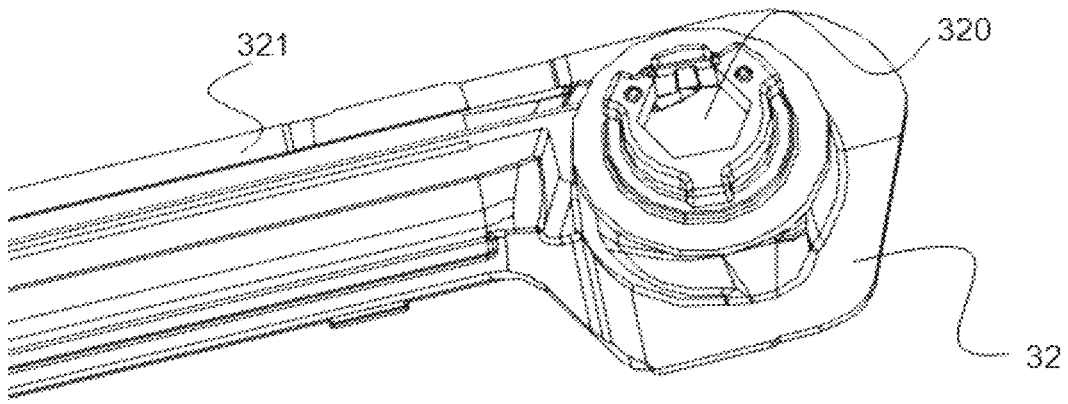
Figure 9A:
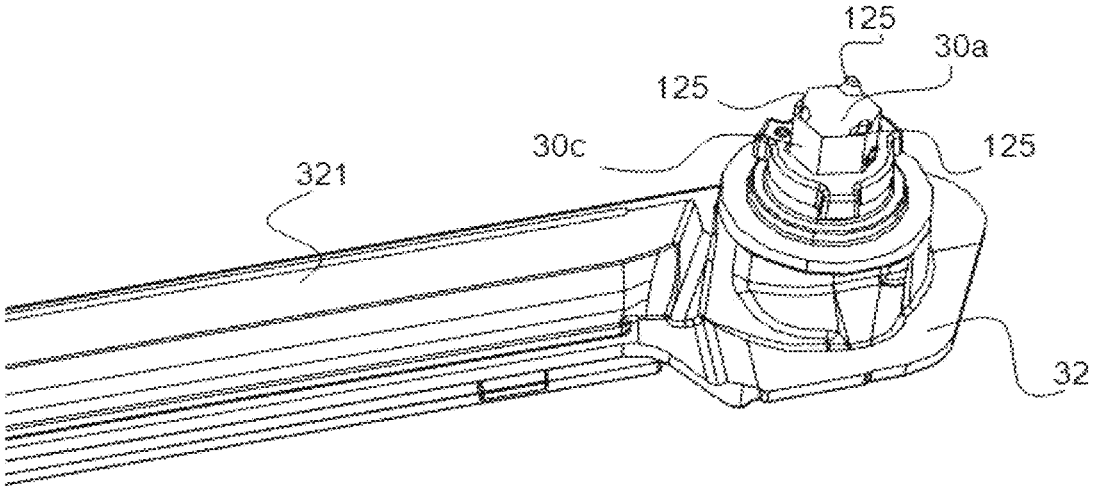
Figure 9B:
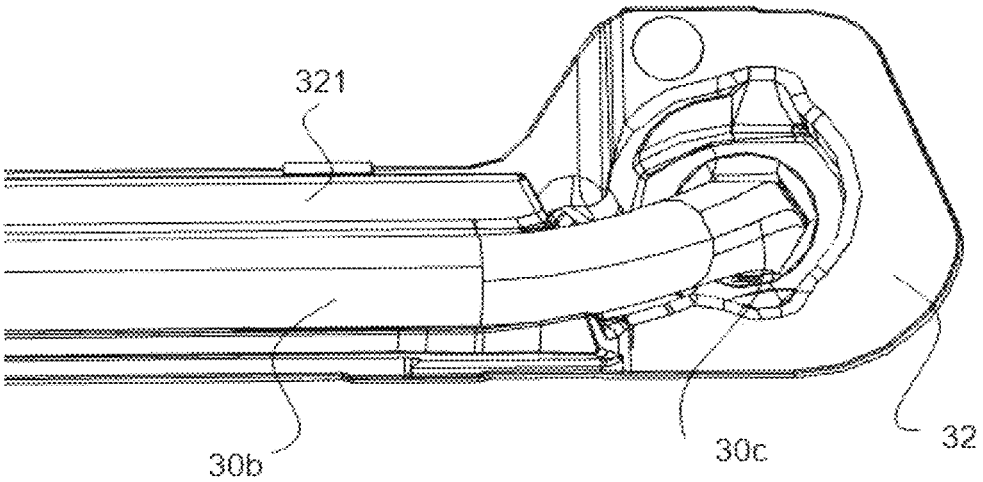
Figure 10:
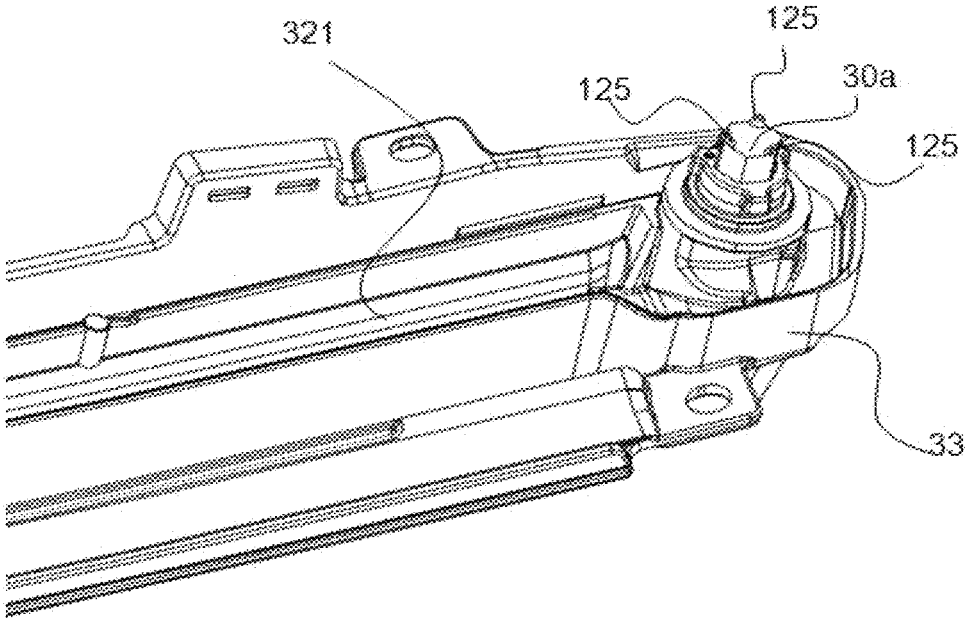
Figure 11A:
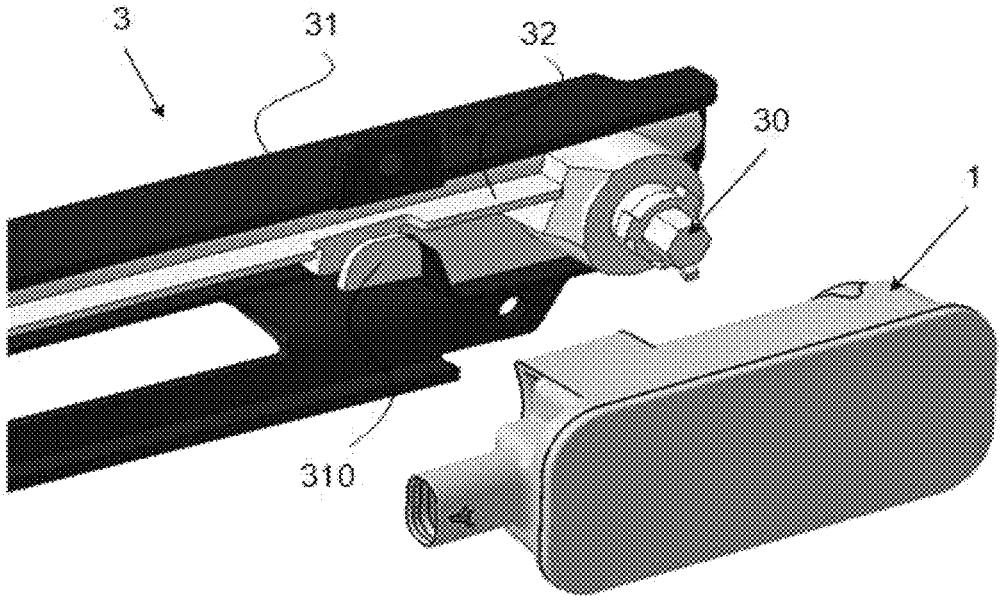
Figure 11B:
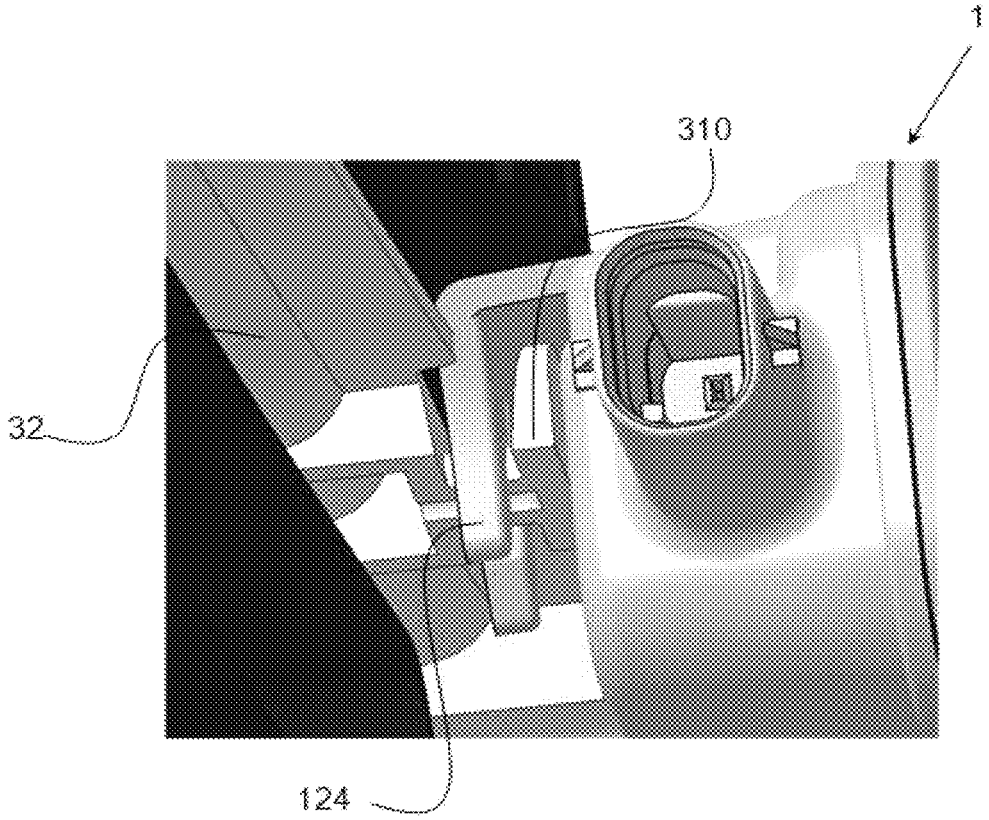
Figure 12A:
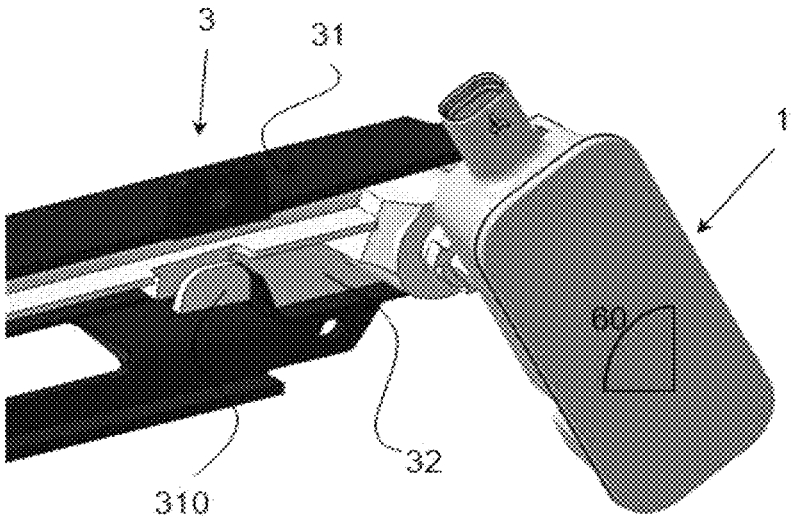
Figure 12B:
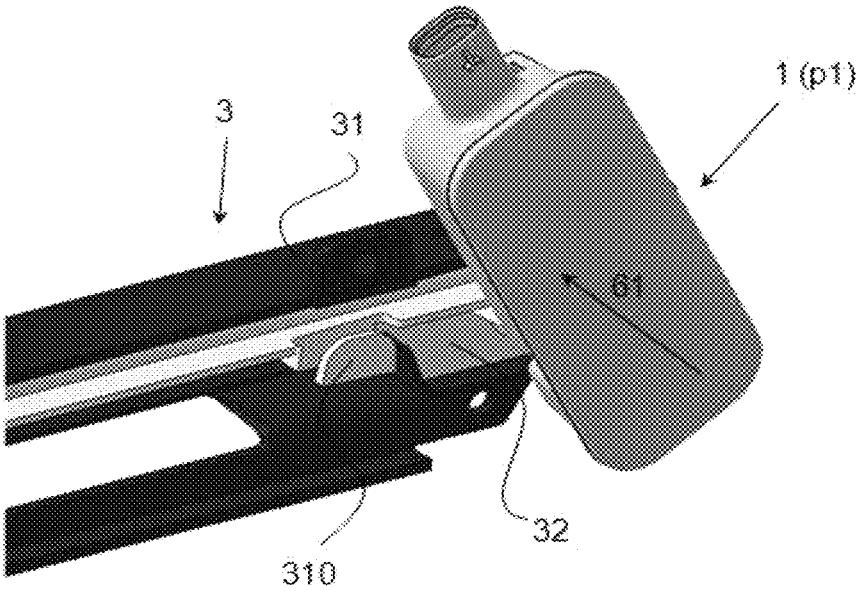
Figure 12C:
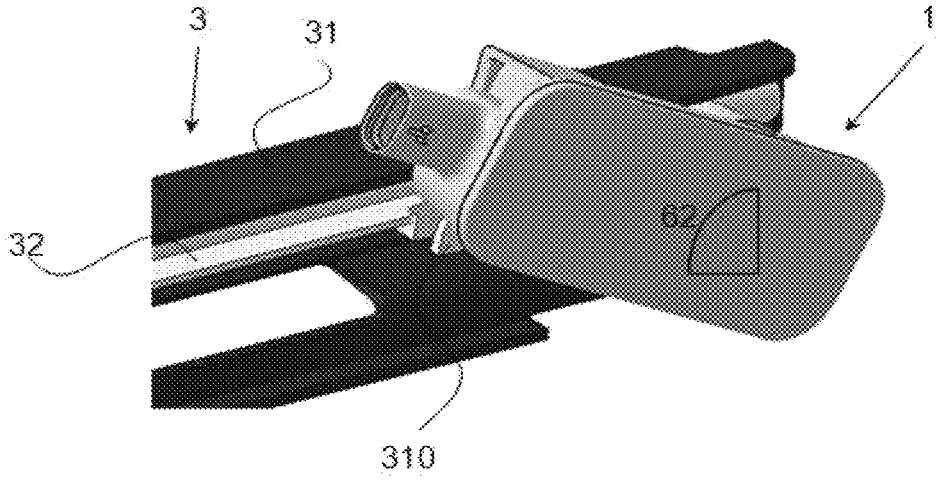
Figure 12D:
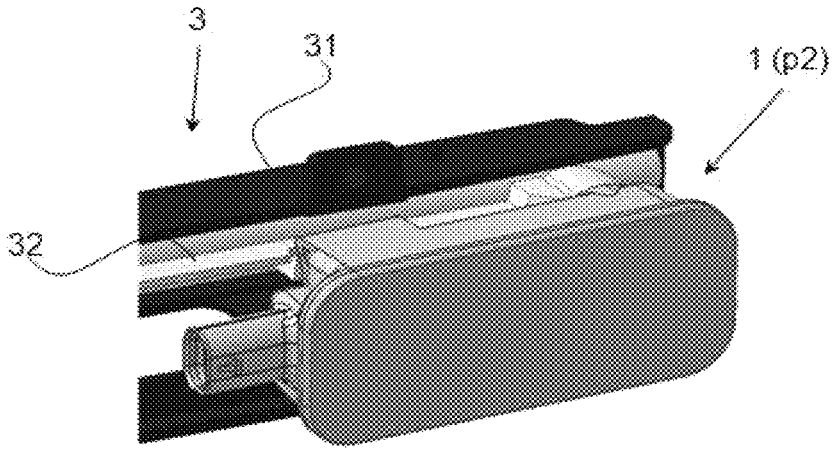
Figure 12E:
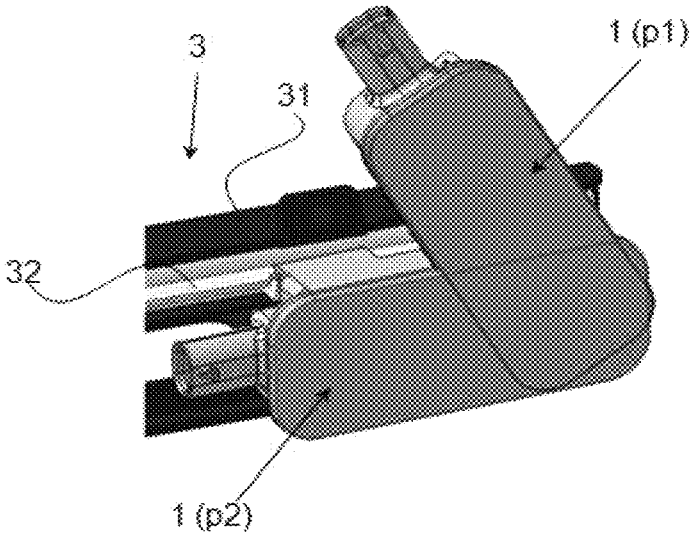

The invention and its various applications will be better understood on reading the following description and examining the figures that accompany it:

FIG. 1*a* shows a three-quarter view from above of a luminous device comprising a luminous module, according to a first non-limiting embodiment of the invention, FIG. 1*b* is a zoom in on the luminous module of FIG. 1*a*, FIG. 2 is a three-quarter view from below of the luminous device of FIG. 1*a*, according to one non-limiting embodiment, FIG. 3*a* shows the luminous module of FIG. 1*b* interacting with an optical element, according to one non-limiting embodiment, FIG. 3*b* is a cross-sectional view of the luminous module of FIG. 3*a* interacting with said optical element, according to one non-limiting embodiment, FIG. 4*a* is an assembled view of the luminous module of FIGS. 1*a* and 1*b*, according to one non-limiting embodiment, FIG. 4*b* is a cross-sectional view of the luminous module of FIG. 4*a*, FIG. 5 is an exploded view of the luminous module of FIG. 4*a*, the luminous module comprising at least one light source, a light-source holder, an open casing, and an element for closing the casing, according to one non-limiting embodiment, FIG. 6*a* is a view of the open casing of FIG. 5, according to one non-limiting embodiment, FIG. 6*b* is a cross-sectional view of the open casing of FIG. 6*a*, according to one non-limiting embodiment, FIG. 6*c* is a zoomed-in view of one portion of the open casing of FIG. 6*a*, according to one non-limiting embodiment, FIG. 7*a* is a perspective view of the optical element of the luminous module of FIG. 3*a*, according to one non-limiting embodiment, FIG. 7*b* is a zoomed-in view of one portion of the optical element of FIG. 7*b*, according to one non-limiting embodiment, FIG. 8 is a zoomed-in view of one portion of an optical-element holder for the optical element of FIGS. 7*a* and 7*b*, according to one non-limiting embodiment, FIG. 9*a* is a first zoomed-in view of the optical element of FIGS. 7*a* and 7*b* mounted on the optical-element holder of FIG. 8, according to one non-limiting embodiment, FIG. 9*b* is a second zoomed-in view of the optical element of FIGS. 7*a* and 7*b* mounted on the optical-element holder of FIG. 8, according to one non-limiting embodiment, FIG. 10 is a zoomed-in view of the assembly consisting of the optical element and the optical-element holder of FIGS. 9*a* and 9*b* assembled with an outer-lens holder of a casing of the vehicle of the luminous device of FIG. 1, according to one non-limiting embodiment, FIG. 11*a* is a partial disassembled view of a luminous device comprising a luminous module and a motor-vehicle casing, according to a second non-limiting embodiment of the invention, FIG. 11*b* is a zoom in on the luminous module assembled on the casing of the motor vehicle of the luminous device of FIG. 11*a*, according to one non-limiting embodiment, FIG. 12*a* is a partial disassembled view of the luminous device of FIG. 11*a*, which illustrates a first step for mounting the luminous module on the casing of the motor vehicle, in which step the luminous module is in a first position, according to one non-limiting embodiment, FIG. 12*b* is a partial view of the luminous device of FIG. 11*a*, which illustrates a second step for mounting the luminous module on the casing of the motor vehicle, according to one non-limiting embodiment, FIG. 12*c* is a partial view of the luminous device of FIG. 11*a*, which illustrates a third step for mounting the luminous module on the casing of the motor vehicle, according to one non-limiting embodiment, FIG. 12*d* is a partial assembled view of the luminous device of FIG. 11*a*, which illustrates a fourth step for mounting the luminous module on the casing of the motor vehicle, in which step the luminous module is in a second position, according to one non-limiting embodiment, and FIG. 12*e* is a partial view of the luminous device of FIG. 11*a*, which illustrates the passage of the luminous module between the first position of FIG. 12*a* and the second position of FIG. 12*d*, according to one non-limiting embodiment.

Elements that are identical, in structure or in function, and that appear in a number of different figures have, unless otherwise specified, been designated with the same references.

The luminous motor-vehicle module 1 according to the invention is described with reference to FIGS. 1*a* to 12*d*. The term motor vehicle is understood to mean any type of motorized vehicle.

The luminous module 1 is juxtaposed with a casing 3 of the motor vehicle, the whole forming a luminous device 4. The luminous module 1 thus forms part of a luminous device 4 (illustrated in FIG. 1*a*). In non-limiting embodiments, the luminous device 4 is a signaling light and/or a headlamp, or an interior lighting device.

In one non-limiting embodiment (illustrated in FIG. 1*a*), the casing 3 comprises an aperture closed by an outer lens 31. In non-limiting embodiments, the casing 3 comprises:

a) at least one optical element 30, such as illustrated in FIG. 3*a*, closed by an outer lens 31, such as illustrated in FIG. 1*a*, or b) an outer lens 31 alone.

It will be noted that the casing 3 may comprise other components configured to emit a light beam independently of the luminous module 1. The casing 3 is also referred to as the second casing 3 in the rest of the description.

Non-limiting embodiment a) is taken by way of non-limiting example in the rest of the description. The outer lens 31 is formed from an outer-lens holder 33 and from a transparent optical part 34. It closes the casing 3. The casing 3 further comprises an optical-element holder 32. Such as shown in FIG. 8, the optical-element holder 32 comprises an orifice 320 through which a tip 30*c* of the optical element 30 may pass. In one non-limiting embodiment, the orifice 320 has a hexagonal shape that interacts with a hexagonal shape of the tip 30*c* of the optical element 30. The optical element 30 is thus held in position, such as illustrated in FIG. 9*a*. Moreover, the optical-element holder 32 comprises a longitudinal body 321 in which the body 30*b* of the optical element 30 may be accommodated, such as illustrated in FIG. 9*b*. The optical-element holder 32 is configured to interact with the outer-lens holder 33, such as shown in FIG. 10. As may be seen, the outer-lens holder 33 covers the optical-element holder 32.

The casing 3 further comprises a hooking bracket 310 for fastening the luminous module 1 to said casing 3 and blocking it in position. In a first non-limiting embodiment illustrated in FIG. 1*b*, the hooking bracket 310 is secured to said outer-lens holder 33. As may be seen in FIG. 1*b*, the hooking tab 124 of the luminous module 1 interacts with the hooking bracket 310 of the outer-lens holder 33.

In a second embodiment illustrated in FIG. 11*a*, the hooking bracket 310 is secured to said optical-element holder 32. As may be seen in FIG. 11*b*, the hooking tab 124 of the luminous module 1 interacts with the hooking bracket 310 of the optical-element holder 32.

In one non-limiting embodiment, the luminous module 1 is an additional signaling light juxtaposed with the casing 3 comprising said at least one optical element 30 closed by an outer lens 31. The signaling light allows a luminous signaling function to be performed. The signaling light is taken by way of non-limiting example in the rest of the description. Of course, the invention is not limited to a signaling light, and may be applied to other types of luminous modules. The optical element 30 is configured to interact with at least one light source 10 (described below) of said luminous module 1. In one non-limiting embodiment, it forms a headlamp. The headlamp enables a luminous lighting function to be performed. Of course, the invention is not limited to a headlamp. Thus, in the non-limiting embodiment taken as example, the luminous device 4 is a headlamp and a signaling light.

In one non-limiting embodiment, the luminous signaling function is:

a turn indicator (TI), and/or
a daytime running light (DRL), and/or
a parking lamp (PL), and/or
a position or "tail" lamp (T), and/or
a stop lamp (STP), and/or
a reversing light (R), and/or
a fog light (FG), and/or
a side marker (SM), and/or
a center high-mount stop light (CHMSL).

Such as illustrated in FIGS. 1*a* to 2, the luminous module 1 is mounted on the casing 3 of the motor vehicle. In particular, it is mounted on the rear 3*a* of said casing 3. In one non-limiting embodiment, the luminous module 1 is mounted between the casing 3 and the body (not illustrated) of the motor vehicle. It is mounted in a space that is limited, especially depthwise. In one non-limiting example, this space is about 10 centimeters. In one non-limiting example, there is a clearance of about 10 mm between the luminous module 1 and the body. Such as illustrated in FIG. 1*a*, the luminous module 1 is juxtaposed with the casing 3. The outer lens 31 of the casing 3 is on the side opposite to the luminous module 1. It is located on the front side 3*b* of the casing 3.

The optical element 30 of the casing 3 lies beside said outer lens 31. In the non-limiting example illustrated in FIGS. 3*a* and 3*b*, the optical element 30 of the casing 3 is a light guide that extends along the casing 3. [46] This non-limiting embodiment is taken by way of non-limiting example in the rest of the description. Such as illustrated in FIGS. 7*a* and 7*b*, the light guide 30 comprises reflective elements 30*d* and a body 30*b* with two ends 30*c*, one of the ends 30*c* comprising a planar surface 30*a*. The planar surface 30*a* is configured to be placed facing the light source 10. The body 30*b* is configured to be placed in the optical-element holder 32, such as shown in FIG. 9*b*. One of the ends 30*c* of the body 30*b* is configured to be inserted into the interface 122 of the open casing 12, which interface is described below. In one non-limiting embodiment, said end 30*c* has a hexagonal shape so as to ensure it is correctly fitted into the orifice 321 of the optical-element holder 32. Moreover, in one non-limiting embodiment illustrated in FIG. 7*b*, the light guide 30 further comprises lugs 300 for positioning the luminous module 1. In one illustrated non-limiting example, it comprises two positioning lugs 300. In one non-limiting embodiment, the light guide 30 is positioned at the center of said positioning lugs 300. The positioning lugs 300 are placed around the light guide 30. This allows better positioning with respect to said light source 10 described below. The positioning lugs 300 are placed on the periphery of one of the ends 30*c* of the light guide 30. The positioning lugs 300 are configured to interact with grooves 127 and guiding regions 128 of a positioning housing 126 of the open casing 12, such as described below.

Such as illustrated in FIGS. 4*a* to 5, the luminous module 1 comprises:

- at least one light source 10,
- a light-source holder 11,
- an open casing 12,
- an element 13 for closing the open casing 12,
- a primary electrical-connection element 14 connected to the light-source holder 11,
- a secondary electrical-connection element 15 connected to the casing.

These various elements are described in detail below.

The light source 10 is illustrated in FIGS. 3*b*, 4*b* and 5. In one illustrated non-limiting embodiment, the luminous module 1 comprises a single light source 10. In another non-limiting embodiment (not illustrated), the luminous module 1 comprises a plurality of light sources 10. In one non-limiting embodiment, said at least one light source 10 is a semiconductor light source. In one non-limiting embodiment, the semiconductor light source forms part of a light-emitting diode. By light-emitting diode, what is meant is any type of light-emitting diode, i.e. any of a conventional LED (light-emitting diode), an OLED (organic LED), an AMOLED (active-matrix-organic LED) or a FOLED (flexible OLED), to give non-limiting examples.

Said at least one light source 10 is configured to emit light rays which interact with the optical element 30 to generate a light beam. Said light beam allows the luminous signaling function to be performed. In the non-limiting example illustrated in FIG. 3*b*, said at least one light source 10 interacts with the light guide 30. It is placed facing one end of the light guide 30. In one non-limiting embodiment, said at least one light source 10 is placed on the light-source holder 11 described below.

The light-source holder 11 is illustrated in FIGS. 3*b*, 4*b* and 5. It is sandwiched between the open casing 12 and the closing element 13. It lies at 90° with respect to the axis of emission of the light rays from said at least one light source 10. In one non-limiting embodiment illustrated in FIG. 5, the light-source holder 11 is a printed circuit board assembly (PCBA). This PCBA comprises electronic components (not illustrated) such as, in one non-limiting example, a driver (not illustrated) for controlling said at least one light source 10.

Such as illustrated in FIG. 5, the primary electrical-connection element 14 is connected to the light-source holder 11. Such as illustrated in FIG. 4*b*, it interacts with the secondary electrical-connection element 15 to make an electrical connection. In one non-limiting embodiment, said primary electrical-connection element 14 is soldered to the light-source holder 11. In one illustrated non-limiting embodiment, said primary electrical-connection element 14 is a female connector. Having a female connector on the light-source holder 11 allows a more stable bearing surface to be achieved than would be the case if a male connector were used. Such as illustrated in FIG. 5, the female connector 14 is composed of two terminals 14*a*, 14*b* (one positive, the other negative) joined to the light-source holder 11. In one non-limiting example, the two terminals 14*a*, 14*b* are soldered to the light-source holder 11.

In one non-limiting embodiment (not shown in FIG. 5), the light-source holder 11 further comprises at least one reference orifice 110 configured to position it with respect to the open casing 12. In one non-limiting variant embodiment, it comprises two reference orifices 110. The latter interact with two reference pins 120 of the open casing 12. They provide a reference with respect to Y- and Z-axes parallel to the light-source holder 11.

In one non-limiting embodiment (not shown in FIG. 5), the light-source holder 11 further comprises at least one positioning orifice 111 configured to guide the open casing 12 when it is assembled with the closing element 13. In one non-limiting variant embodiment, it comprises three positioning orifices 111. They interact with three positioning tabs 121 of the open casing 12. They ensure correct positioning laterally (in both lateral directions).

The closing element 13 is illustrated in FIGS. 1*b* to 5. In one non-limiting embodiment, the closing element 13 is a radiator or a closing cover. In the illustrated non-limiting example, it is a radiator. In one non-limiting embodiment, the closing element 13 is fastened to the open casing 12 by welding. The light-source holder 11 is fastened to the closing element 13. When the closing element 13 is a radiator, in one non-limiting embodiment, the light-source holder 11 is fastened to the radiator 13 via an adhesive. When the closing element 13 is a closing cover, in one non-limiting embodiment (not illustrated), the light-source holder 11 is fastened to the closing cover 13 via fastening clips or rivets. In one non-limiting embodiment illustrated in FIG. 5, the closing element 13 comprises at least one slide 131 for positioning the open casing 12. In one non-limiting variant embodiment, it comprises three slides 131. They interact with the positioning tabs 121 of the open casing 12.

The open casing 12 is illustrated in FIGS. 1*b* to 6*b*. It is configured to cover the light-source holder 11. In one non-limiting embodiment illustrated in FIG. 6*a*, the open casing 12 comprises at least one reference pin 120 for positioning the light-source holder 11. In one non-limiting variant embodiment, it comprises two reference pins 120. The two reference pins 120 are configured to ensure positioning of the light-source holder 11. They interact with the reference orifices 110 of the light-source holder 11. In one non-limiting embodiment illustrated in FIG. 6*a*, the open casing 12 comprises at least one positioning tab 121. In one non-limiting variant embodiment, it comprises three positioning tabs 121. The three positioning tabs 121 are configured to correctly position the open casing 12 with respect to the closing element of the casing 13. These positioning tabs 121 are configured to pass through the positioning orifices 111 of the light-source holder and to engage in the slides 131 of the closing element 13.

In one non-limiting embodiment illustrated in FIGS. 3*b* to 6*b*, the open casing 12 further comprises an interface 122 with the optical element 30. In one non-limiting variant embodiment, this interface 122 is circular. In the non-limiting example of the light guide 30, such as illustrated in FIG. 3*b*, one end 30*c* of the light guide 30 may be inserted into this interface 122. The interface 122 is located facing the light source 10 so that the end 30*c*, and in particular its planar surface 30*a*, of the light guide 30 is located facing the light source 10. Thus, the light rays of the light source 10 are directed into the light guide 30. The interface 122 comprises an O-ring 1220 which ensures seal-tightness.

In one non-limiting embodiment illustrated in the figures, the open casing 12 further comprises a connector portion 123. Such as illustrated in FIG. 6*b*, a secondary connection portion 151 of the secondary electrical-connection element 15 is inserted into the connector portion 123, and configured to interact with an external connector (not illustrated) of the motor vehicle that allows the PCBA to be powered.

In one non-limiting embodiment illustrated in FIG. 6*a*, the open casing 12 further comprises a positioning housing 126 with a plurality of grooves 127. Such as illustrated in FIG. 6*c*, the positioning housing 126 comprises a central axis Ax1 perpendicular to the longitudinal direction of the open casing 12. The positioning housing 126 has a substantially circular cross section and opens onto the interface 122 and the interior of the open casing 12. The grooves 127 are produced in the housing 126. Such as illustrated in FIG. 6*b*, the positioning housing 126 comprises a collar 1260 in which said grooves 127 are produced. Said grooves 127 start from said collar 1260 to open into said housing 126, interior side of the open casing 12. The positioning housing 126 allows the light guide 30, and in particular one of its ends 30*c* which may be inserted into said positioning housing 126, to be accommodated. The grooves 127 allow the positioning lugs 300 of the light guide 30 to be blocked.

In one non-limiting example (not illustrated), the positioning housing 126 comprises three grooves 127. In one non-limiting embodiment, the three grooves 127 are angularly offset by 120°. In another non-limiting example (not illustrated), it comprises two grooves 127. In one non-limiting embodiment, the two grooves 127 are angularly offset by 180°, i.e. they are placed facing each other. Angularly offsetting the grooves 127 allows guiding regions 128 to be realized in the positioning housing 126, such as illustrated in FIG. 6*c*. Such as illustrated in FIG. 6*c*, the guiding regions 128 are circularly arcuate. They are located on the inside circumference of the collar 1260. In the non-limiting embodiment illustrated, there are three guiding regions 128, two of which end with a stop 128*b*. In one illustrated non-limiting embodiment, each circular arc 128 is thus offset by 120° with respect to an adjacent circular arc.

In one non-limiting embodiment illustrated in FIGS. 1*b* and 4*a*, the open casing 12 further comprises a tab 124 for hooking on the casing 3. The hooking tab 124 is configured to hook onto the hooking bracket 310 of the casing 3. As will be seen below, the luminous module 1 is configured to make a rotation and, at the end of the rotation, to hook onto a second casing 3 of the motor vehicle via its hooking tab 124 of its open casing 12. According to a first non-limiting embodiment illustrated in FIG. 1*b*, the hooking tab 124 interacts with a hooking bracket 310 of the outer-lens holder 31 of the casing 3. In particular, it is clipped onto said hooking bracket 310. According to a second non-limiting embodiment illustrated in FIG. 11*b*, the hooking tab 124 interacts with a hooking bracket 310 of the optical-element holder 32 of the casing 3. In particular, it is clipped onto said hooking bracket 310.

In one non-limiting embodiment illustrated in FIG. 3*b*, the open casing 12 further comprises means 125 for centering the light source 10 with respect to the optical element 30.

The secondary electrical-connection element 15 is illustrated in FIGS. 6*a* and 6*b*. As illustrated, the secondary electrical-connection element 15 is connected to the open casing 12. In one non-limiting embodiment, said open casing 12 is overmolded onto the secondary electrical-connection element 15. With an overmolding process, the secondary electrical-connection element 15 is placed in an injection mold, then the material of the open casing 12 is injected into the injection mold to obtain the part. This allows seal-tightness to be ensured and a precise assembly dimension to be respected. The secondary electrical-connection element 15 is configured to interact with the primary electrical-connection element 14. In one non-limiting embodiment, the secondary electrical-connection element 15 is a male connector. Having a male connector on the open casing 12 is simpler to manufacture than having a male connector on the light-source holder 11.

Assembly, along an X-axis perpendicular to the light-source holder 11, of the light-source holder 11 and the open casing 12 is thus facilitated by the male connector 15 and female connector 14 such as seen above. Electrical connection of the male connector 15 and the female connector 14 during assembly of the light-source holder 11 and the open casing 12 is thus simple to achieve.

Such as illustrated in FIGS. 6*a* and 6*b*, the secondary electrical-connection element 15 comprises:

- a primary connection portion 150 connected to said primary electrical-connection element 14, and
- a secondary connection portion 151 connected to the external connector of the motor vehicle.

The fact that the secondary connecting element 15 allows both a connection to the PCBA via the primary connection portion 150, and a connection to the external connector via the secondary connection portion 151, makes it possible not to use an internal cable harness between the light-source holder 11 and the external connector of the motor vehicle, which would cause problems with electromagnetic compatibility. Electromagnetic compatibility problems are thus avoided. This also avoids problems with positioning the internal cable harness inside the open casing 12, once the open casing 12, the light-source holder 11 and the closing element 13 have been assembled. Specifically, if such an internal cable harness were used, it would be necessary for it to be very long for the light source 10 to be replaceable.

The primary connection portion 150 forms the male connector. It comprises two terminals 150*a*, 150*b* (one positive, the other negative) configured to interact with the two terminals 14*a*, 14*b* of the primary electrical-connection element 14, respectively. In one non-limiting embodiment, the two terminals 150*a*, 150*b* are integrated into the open casing 12 by overmolding. Such as illustrated in FIG. 6*b*, the primary connection portion 150 extends in a first direction AX. It makes planar contact with the open casing 12, this preventing any deformation and the terminals 150*a*, 150*b* from moving.

The secondary connection portion 151 forms a male connector that is configured to plug into a female connector (not illustrated) formed in the external connector of the motor vehicle. It comprises two terminals 151*a*, 151*b* (one positive, the other negative). The secondary connection portion 151 extends in a second direction AY. The second direction AY makes an angle β to the first direction AX comprised between 45° and 135°. By virtue of this arrangement with an angle β, it is possible to mount the luminous module 1 between the second casing 3 and the body of the motor vehicle along the X-axis, and to demount it with a view to replacing it once the luminous device 4 has been mounted on the motor vehicle. This also allows small dimensions, in particular as regards the width of the luminous module 1, to be achieved, this allowing it to be easily integrated into the space between the second casing 3 and the body of the motor vehicle.

In one illustrated non-limiting embodiment, the angle β is 90°.

Thus, the first direction AX is perpendicular to the light-source holder 11 and the second direction AY is parallel to the light-source holder 11 and to the second casing 3. Having the secondary connection portion parallel to the second casing 3 allows a connection to be made to the external connector 5 parallel to the second casing 3. The dimensions of the luminous module 1 may thus be reduced, in particular along the X-axis, and the luminous module 1 takes up less space than if the connection was perpendicular to the second casing 3 for example.

Such as illustrated in FIGS. 4*b* and 6*b*, the primary connection portion 150 and the secondary connection portion 151 are interconnected via an elbow 152 that allows the angle β to be made. Thus, the terminal 150*a* of the primary connection portion 150 is connected by an elbow to the terminal 151*a* of the secondary connection portion 151, and the terminal 150*b* of the primary connection portion 150 is connected by an elbow to the terminal 151*b* of the secondary connection portion 151.

An operator mounts the luminous module 1 on the casing 3 of the motor vehicle as follows, with reference to FIGS. 12*a* to 12*d*. In FIGS. 12*a* to 12*d*, the second embodiment with the hooking bracket 310 that hooks onto the optical-element holder 32 of the second casing 3 is taken by way of non-limiting example to illustrate said mounting operation.

In a first step illustrated in FIG. 12*a*, the luminous module 1 is placed by the operator between the second casing 3 and the body of the motor vehicle. He turns it so that it makes an angle to the longitudinal axis of the second casing 3. The rotation is illustrated by the arrow referenced 60 in the figure.

In a second step illustrated in FIG. 12*b*, the luminous module 1 is positioned by the operator so that the grooves 127 of the open casing 12 of the luminous module 1 are located facing the positioning lugs 300 of the casing 3. Next, the operator pushes the luminous module 1 translationally along an axis (not shown) perpendicular to the longitudinal axis of the second casing 3 so that the positioning lugs 300 of the casing 3 insert into said grooves 127 of the open casing 12. The luminous module 1 is thus placed in a first position p1. The luminous module 1 is thus pre-positioned on the second casing 3. The translation is illustrated by the arrow referenced 61 in the figure.

In a third step illustrated in FIG. 12*c*, the operator turns the luminous module 1 so that it makes a rotation. During this rotation, the positioning lugs 300 of the second casing 3 slide along the guiding regions 128 of the open casing 12 until they are stopped by the stops 128*b* of said guiding regions 128. The rotation is illustrated by the arrow referenced 62 in the figure. The stops 128*b* allow the end of the rotation to be blocked.

In a fourth step illustrated in FIG. 12*d*, the rotation of the luminous module 1 ends when the hooking tab 124 of the open casing 12 meshes with the hooking bracket 310 of the second casing 3, clipping onto said hooking bracket 310. Thus, the open casing 12 is locked on the second casing 3. Thus, the hooking device formed by the hooking tab 124 and the hooking bracket 310 allows untimely unlocking of the open casing 12 to be avoided, especially when the motor vehicle is being driven. The luminous module 1 is thus attached to the second casing 3. The luminous module 1 is thus placed in a second position p2, which could be called the mounted position.

FIG. 12*e* thus illustrates the luminous module 1 passing from the first position p1 to the second position p2.

Of course, the description of the invention is not limited to the embodiments described above and to the field described above.

Thus, in another non-limiting embodiment, said primary electrical-connection element 14 is a male connector and said secondary electrical-connection element 15 is a female connector.

Thus, in another non-limiting embodiment, said secondary electrical-connection element 15 is adhesively bonded to said open casing 12 instead of being overmolded, especially as regards its primary connection portion 150.

Thus, in another non-limiting embodiment, instead of welding the closing element 13 and the open casing 12 short fastening screws, for example screws that are shorter than 5 mm in length, may be used to fasten them together. In this other non-limiting embodiment, it is furthermore possible to place a seal between the open casing 12 and the closing element of the casing 13, which makes it possible to ensure not only that the open casing 12 is closed with the closing element 13 of the casing, but also a good seal-tightness.

Thus, the described invention especially has the following advantages:

- it allows the luminous module 1 to be mounted in a limited space,
- it allows said light source 10 to be mounted/demounted along the X-axis on/from the light-source holder 11 without having to demount the entire luminous device 4 and this to be done solely by means of a screwdriver. The casing 3 thus remains mounted on the motor vehicle,
- it allows the use of a cable harness and the problems associated with its use to be avoided.

The invention claimed is:

1. A luminous motor-vehicle module comprising:

at least one light source, an open casing having the at least one light source positioned therein, and a closing element for closing said open casing to contain the at least one light source therein, wherein said open casing comprises a positioning housing for positioning the open casing on an end of an elongated optical element to receive light from the at least one light source, said positioning housing comprising a plurality of grooves, and a hooking tab for hooking the luminous motor-vehicle module on a lamp casing of said motor vehicle, said lamp casing comprising an optical element holder configured to hold a portion of said elongated optical element and an outer lens for closing said lamp casing to contain the portion of the elongated optical element therein, said luminous motor-vehicle module being configured to make a rotation engagement with the lamp casing by rotation of the luminous motor vehicle module about an axis of the end of the elongated optical element such that, at an end of rotation travel, the hooking tab hooks onto said lamp casing.

2. The luminous motor-vehicle module as claimed in claim 1, wherein said elongated optical element is a light guide.

3. The luminous motor-vehicle module as claimed in claim 1, wherein said positioning housing comprises two or three grooves corresponding to the respective lugs on the lamp casing.

4. The luminous motor-vehicle module as claimed in claim 1, wherein said hooking tab is configured to hook onto a hooking bracket of the optical-element holder of said lamp casing of the motor vehicle, or configured to hook onto a hooking bracket of an outer-lens holder of said lamp casing of the motor vehicle.

5. A motor-vehicle lamp casing comprising:

an elongated optical element having a light input end, an optical-element holder configured to hold a portion of the elongated optical element, an outer lens formed from an outer-lens holder and from a transparent optical part, a hooking bracket configured to engage a hooking tab of a luminous module which contains the end of the elongated optical element therein, said hooking bracket being secured to said optical-element holder or to said outer-lens holder, and a rotation engagement configured to make a rotation engagement with the luminous module by rotation of the luminous module about an axis of the end of the elongated optical element such that, at an end of the rotation travel, the lamp casing is rotationally engaged with the luminous module and the hooking bracket is engaged with a hooking tab of the luminous module.

6. The motor-vehicle lamp casing as claimed in claim 5, wherein said elongated optical element comprises lugs for positioning a-luminous module on the elongated optical element.

7. The motor-vehicle lamp casing as claimed in claim 6, wherein said elongated optical element comprises a light input end positioned at the center of said positioning lugs.

8. A luminous device comprising a luminous module as claimed in claim 1, further comprising a lamp casing comprising:

an elongated optical element, an optical-element holder configured to hold a portion of the elongated optical element, an outer lens formed from an outer-lens holder and from a transparent optical part, a hooking bracket configured to engage a hooking tab of a luminous module which contains an end of the elongated optical element therein, said hooking bracket being secured to said optical-element holder or to said outer-lens holder.

9. The luminous device as claimed in claim 8, wherein said luminous device is a signaling light and/or a headlamp, or an interior lighting device.

10. The luminous module as claimed in claim 2, wherein said positioning housing comprises two or three grooves.

11. The luminous module as claimed in claim 2, wherein said hooking tab is configured to hook onto a hooking bracket of an optical-element holder of said lamp casing of the motor vehicle, or configured to hook onto a hooking bracket of an outer-lens holder of said lamp casing of the motor vehicle.

12. The luminous module as claimed in claim 3, wherein said hooking tab is configured to hook onto a hooking bracket of an optical-element holder of said lamp casing of the motor vehicle, or configured to hook onto a hooking bracket of an outer-lens holder of said lamp casing of the motor vehicle.

13. A luminous device comprising a luminous module as claimed in claim 2, further comprising a lamp casing comprising:

an elongated optical element, an optical-element holder configured to hold a portion of the elongated optical element, an outer lens formed from an outer-lens holder and from a transparent optical part, a hooking bracket configured to engage a hooking tab of a luminous module which contains an end of the elongated optical element therein, said hooking bracket being secured to said optical-element holder or to said outer-lens holder.

14. A luminous device comprising a luminous module as claimed in claim 3, further comprising a casing comprising:

an elongated optical element, an optical-element holder configured to hold a portion of the elongated optical element, an outer lens formed from an outer-lens holder and from a transparent optical part, a hooking bracket configured to engage a hooking tab of a luminous module which contains an end of the elongated optical element therein, said hooking bracket being secured to said optical-element holder or to said outer-lens holder.

15. A luminous device comprising a luminous module as claimed in claim 4, further comprising a casing comprising:

an elongated optical element, an optical-element holder configured to hold a portion of the elongated optical element, an outer lens formed from an outer-lens holder and from a transparent optical part, a hooking bracket configured to engage a hooking tab of a luminous module which contains an end of the elongated optical element therein, said hooking bracket being secured to said optical-element holder or to said outer-lens holder.

* * * * *